United States Patent [19]

Walker et al.

[11] Patent Number: 4,819,672

[45] Date of Patent: Apr. 11, 1989

[54] NAIL POLISH REMOVER CONTAINER

[75] Inventors: Alvin M. Walker, Seminole; Charles E. Tighe, Dunedin, both of Fla.

[73] Assignee: Walker Marketing Inc., Clearwater, Fla.

[21] Appl. No.: 106,260

[22] Filed: Oct. 9, 1987

[51] Int. Cl.[4] ..... A45D 29/20

[52] U.S. Cl. ..... 132/75; 132/73.5

[58] Field of Search ..... 132/73, 73.5, 74.5, 132/75; 47/80, 41.12, 41.13, 14.11, 14 SS

[56] References Cited

U.S. PATENT DOCUMENTS

| | | | |
|---|---|---|---|
| 2,524,681 | 10/1950 | Roosa | 132/75 |
| 2,629,124 | 2/1953 | Merritt | 132/75 |
| 2,865,137 | 12/1958 | Longacre | 47/80 |
| 3,316,922 | 5/1967 | Seidler | 132/75 |
| 4,321,936 | 3/1982 | Chaconas | 132/75 |

*Primary Examiner*—Gene Mancene
*Assistant Examiner*—Adriene J. Lepiane
*Attorney, Agent, or Firm*—Gipple & Hale

[57] ABSTRACT

A manicuring device adapted for removing fingernail polish comprising a cylindrical receptacle defining an interior annular channel and a bottom rib, and a brush member inserted into the receptacle and locked in place in the channel and against the rib. The brush member comprises hollow body with a plurality of flexible integral bristles extending inward and defining a plurality of slits allowing fluid to pass into the interior of the body. The brush member has a circular flange portion on one end and a plurality of legs extending substantially perpendicular from the plane of the flange portion.

12 Claims, 2 Drawing Sheets

NAIL POLISH REMOVER CONTAINER

BACKGROUND OF THE INVENTION

The prior art contains many patents directed to nail polish removal receptacles which support or suspend an insert structure to aid in the removal of hardened nail polish from individuals' fingernails after the finger has been immersed into nail polish remover contained within the receptacle. U.S. Pat. Nos. 4,474,195; 4,440,181 and 4,282,891 disclose nail polish remover devices in which a receptacle is provided with a sponge or sponge-like absorbent member insert. The sponge member insert is provided with an aperture forming a finger hole into which the finger is placed. The absorbent sponge absorbs nail polish remover and upon insertion of finger into the sponge aperture, the polished fingernail comes into contact with the sponge and nail polish remover solution so that the solution removes the polish from the nail. The solution and polish fragments are wiped from the inserted fingernail as the fingernail is removed from the jar by the sponge.

U.S. Pat. No. 4,397,324 discloses a nail polish receptacle which is provided with a brush member. The brush member is disposed in the receptacle by wire legs which support the brush element in the approximate determinus of a circular finger opening. U.S. Pat. No. 4,321,936 discloses a nail polish remover receptacle containing a plurality of downwardly spaced apart free floating legs with an inwardly curved end portion. The legs have bristles or brush like elements secured thereto which extend inward. When a person inserts a finger into the device, the finger will contact the bristles and push the legs outward in such a manner that the nail polish liquid on the bristles will remove the nail polish from the fingernails. After a number of uses, the legs tend to spread apart so that a person can get their fingernail caught on the end of the leg, breaking the nail or a portion of the nail during the brushing motion. U.S. Pat. No. 3,316,922 discloses a nail polish remover device in which a circular brush with a circular open center is mounted on a group of abutments which extend inwardly from an insert surface. The brush member is positioned on the abutments and the brush stem is moved against the abutments to snap into inclined position.

The above cited patents have taken great pains to suspend the brush element within a receptacle overlooking a simple means of accomplishing this task. Thus the brush element as suspended within the receptacle does not provide the most efficient way of removing the nail polish from the fingernail, as well as being comprised of multiple pieces of separate construction and assembly which add to the cost of the unit and make the unit more difficult to assemble. Furthermore, there are reservations about the use of a sponge or sponge-like product in beauty salons because of the occurrence of bacterial collection and growth in the sponge.

SUMMARY OF THE INVENTION

The present invention provides for a unique one piece extrusion molded unit which provides for better fingernail cleaning through the use of molded brush bristles. The nail polish remover includes a sturdy brush insert member which has integral flexible bristles positioned in a fixed relationship for maximum interaction with a fingernail.

The brush insert member is firmly held in a fixed relation to eliminate catching of the bristles on the fingernail when the finger is inserted into the brush member. In addition, the ends of the brush member do not engage the fingernail which also prevents breaking and tearing. Furthermore, the insert member is provided with a plurality of slits on the side of a bristle row which allows a steady flow of nail polish remover into the brushing area during the brushing period and continuous circulation of the nail polish remover throughout the container. The invention can be easily cleaned or sterilized to remove any bacterial or viral growths as well as any cuticle material that has been torn or pulled off by the brush. This is of particular importance where the cuticle area may be open and/or bleeding due to job related tearing of the cuticles or simply fingernail biting or picking. Such open wound areas could provide transmission of dangerous viruses such as Aids. Thus, the present invention provides a simple but improved brush element and support which is configured to be easily inserted into the receptacle's interior and once inserted, held in place during the period of use of the user.

These and other objects, advantages and novel features of the present invention become apparent when considered with the teachings contained in the detailed disclosure along with the accompanying drawings.

DETAILED DESCRIPTION OF THE PREFERRED EMBODIMENT

Figure 1:
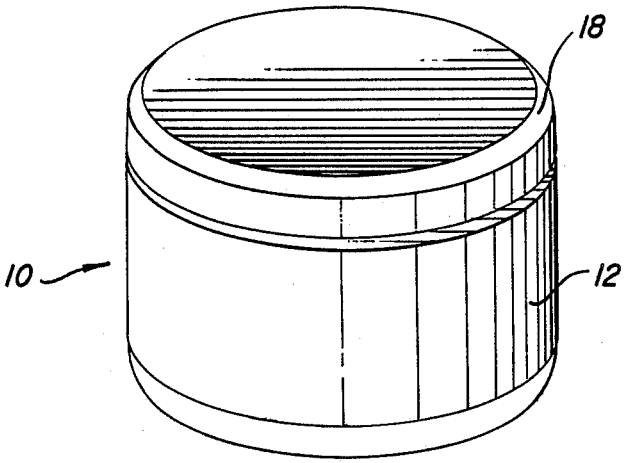
FIG. 1 is a perspective view of the nail polish remover receptacle of the present invention.
Figure 2:
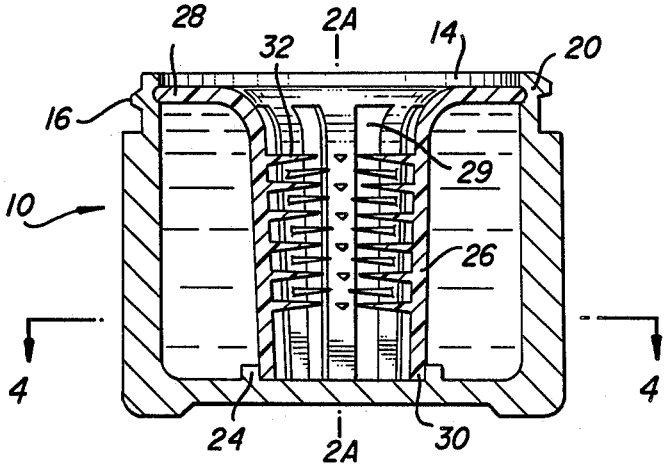
FIG. 2 is a cross-sectional view of the nail polish remover shown in FIG. 1, showing the brush member inserted in the receptacle.
Figure 3:
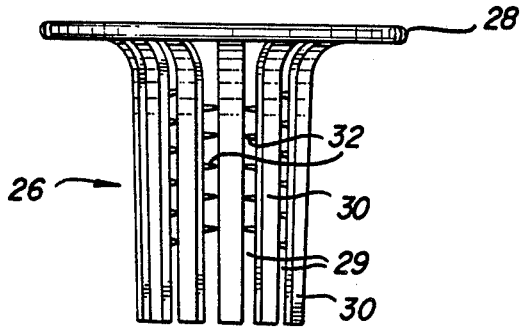
FIG. 3 is a front elevational view of the brush member.

The preferred embodiment and best mode of the invention is shown in FIGS. 1 through 3. As shown in FIG. 1, the container is generally designated as 10 and comprises a cylindrical plastic receptacle 12 having a large circular opening 14 with an outer threaded neck portion 16. The threaded neck portion 16 receives a threaded cap 18 to provide a closed container.

The plastic receptacle 12 defines an annular channel 20 on its inside surface opposite the cap threading area and has formed on its inner bottom surface a circular stop rim 24. A flanged funnel shaped hollow brush member 26 is inserted into the receptacle 12 so that the flange 28 of the brush member fits snugly into the annular channel 20 defined in the receptacle and the lower ends of leg portions 30 of the brush member fit on the inside of the annular rib 24. The brush insert member 26 is provided with a circular flange 28 having a diameter which is greater than the inside diameter of the receptacle 12 and a plurality of downwardly extending portions or legs 30 forming a circular configuration at their ends which fit inside the bottom rim 24. The legs 30 are formed by a plurality of equidistant slits 29 which run from a position removed from the bottom of the flange down through the distal end as is shown in FIG. 3. The legs preferably extend inward toward the center axis 2A of the brush insert at a slope of two degrees. Each leg 30 is provided with a plurality of inwardly projecting bristle members 32 which form a finger brush. As previously indicated, the body defines a plurality of slits 29 positioned in between the bristles 32 to allow nail remover placed within the receptacle to freely flow into the brush area. The brush member has a full 360° radius and has no metal parts or sponge-like foam. The entire construction of the receptacle and brush member is preferably polypropylene and permits a finger to be inserted and withdrawn from the interior of the brush member. The composition of the brush member and receptacle is such that it is virtually impervious to the deleterious effects of nail polish remover in both liquid and vapor phase.

Figure 4:
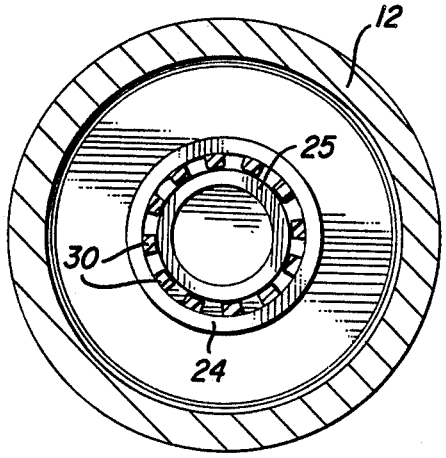
FIG. 4 is a cross-sectional view of an alternative embodiment of the nail polish remover receptacle shown in FIG. 1.

Another embodiment of the invention is shown in FIG. 4. In this embodiment an inner circular stepped rib 25 is used to hold the legs 30 of the brush member therebetween in a fixed manner.

When nail polish remover solvent is added to or contained within the receptacle, a finger is placed down into the brush member so that the brush bristles engage the hardened polish on the fingernail to abrade or fracture the surface of the polish. This fracturing in connection with additional bristles engaging the polish and the action of the polish remover solvent removes the polish from the nail surface. Upon removal of the finger from the receptacle, the bristles revert back to their previous memory position.

If desired, the solvent material can be emptied from the receptacle and the receptacle washed out as desired and reused in any manner desired to provide optimum cleanliness and hygiene.

In the foregoing description, the invention has been described with reference to a particular preferred embodiment, although it is to be understood that specific details shown are merely illustrative, and the invention may be carried out in other ways without departing from the true spirit and scope of the following claims:

What is claimed:

1. A manicuring device adapted for removing fingernail polish comprising a receptacle defining an interior channel and a bottom brush member retainer means comprising an annular rib, an integrally formed brush member inserted into said receptacle and locked in place in said channel and against said annular rib, said brush member comprising a hollow body with a circular flange defining a planar surface on one end of said body and at least six legs defining a sleeve like configuration extending substantially perpendicularly from the plane of the flange portion and engaging said bottom retainer means, each of said legs being provided with bristle means which extend inward toward the center of the sleeve configuration.

2. A device as claimed in claim 1 wherein the bristles extend 360° around the interior of said brush member.

3. A device as claimed in claim 1 wherein said brush member defines an outwardly extending flange having a thickness which is equal to or less than the width of the interior channel and said sleevelike configuration defined by the plurality of legs has an exterior diameter allowing it to fit into the interior diameter of the annular rib.

4. A device as claimed in claim 3 wherein said flange is circular and has a diameter greater than an interior diameter of the receptacle.

5. A device as claimed in claim 1 wherein the interior diameter of the annular rib is equal to or greater than the outer diameter of the distal end of the brush member body.

6. A device as claimed in claim 1 including a second concentric inner annular rib.

7. A device as claimed in claim 6 wherein said second concentric annular rib is spaced in relation to the first annular rib.

8. A device as claimed in claim 6 wherein said second annular rib positioned within said first annular rib holds the legs of said brush member securely therebetween.

9. A device as claimed in claim 8 wherein the space between said annular ribs is equal to the thickness of the end of the brush member legs.

10. A manicuring device for the treatment of fingernails comprising a cylindrical receptacle closed at one end, an inner wall surface of said cylindrical receptacle defining channel means and an inner bottom surface defining a brush member retainer means, a one piece integrally molded brush member inserted into said receptacle and locked in place in said channel means and positioned against said bottom retainer means, said brush member comprising a flanged slitted sleeve.

11. A device as claimed in claim 10 wherein said manicuring device is composed of polypropylene and said device is integrally molded.

12. A manicuring device for the treatment of fingernails comprising a cylindrical receptacle closed at one end defining an annular rib extending upward from the interior of the bottom wall, an integrally molded brush member mounted in said cylindrical receptacle, said brush member comprising a body defining snap means allowing it to be snap mounted to said receptacle and a through going bore and including a plurality of downwardly extending legs integrally formed with said body which abut against the interior surface of the annular rib, each of said legs being provided with integrally formed bristle means.

* * * * *

UNITED STATES PATENT AND TRADEMARK OFFICE

CERTIFICATE OF CORRECTION

PATENT NO. : 4,819,672
DATED : April 11, 1989
INVENTOR(S) : Alvin M. Walker and Charles E. Tighe It is certified that error appears in the above-identified patent and that said Letters Patent is hereby corrected as shown below:

Column 4,
Line 36, insert:
-- forming a plurality of legs spaced by slits, said plurality of legs extending substantially parallel to a central axis of said slitted sleeve, each of said legs having integral bristles extending therefrom --

Signed and Sealed this

Sixth Day of August, 2002

*Attest:*

*Attesting Officer*

JAMES E. ROGAN
*Director of the United States Patent and Trademark Office*